US011278923B2

(12) United States Patent
Isomi et al.

(10) Patent No.: US 11,278,923 B2
(45) Date of Patent: Mar. 22, 2022

(54) SPRAYING APPARATUS

(71) Applicant: Panasonic Intellectual Property Management Co., Ltd., Osaka (JP)

(72) Inventors: Akira Isomi, Osaka (JP); Daisuke Tabata, Osaka (JP); Yuki Ueda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 148 days.

(21) Appl. No.: 16/249,819

(22) Filed: Jan. 16, 2019

(65) Prior Publication Data

US 2019/0232306 A1 Aug. 1, 2019

(30) Foreign Application Priority Data

Jan. 31, 2018 (JP) ..... JP2018-015343

(51) Int. Cl.
*B05B 7/04* (2006.01)
*B01F 5/04* (2006.01)
(Continued)

(52) U.S. Cl.
CPC ..... *B05B 7/0483* (2013.01); *B01F 3/04063* (2013.01); *B01F 5/0461* (2013.01);
(Continued)

(58) Field of Classification Search
CPC ..... B05B 7/045; B05B 7/0458; B05B 7/0483; B05B 7/066; B05B 7/10; B01F 3/04063; B01F 5/0461
(Continued)

(56) References Cited

U.S. PATENT DOCUMENTS 4,272,019 A * 6/1981 Halaby, Jr. ..... B05B 7/10 239/8
5,152,460 A * 10/1992 Barty ..... B05B 7/0081 239/290
(Continued)

FOREIGN PATENT DOCUMENTS

DE 10 2007 034 549 1/2009
JP 2017-127814 7/2017
(Continued)

OTHER PUBLICATIONS

Extended European Search Report dated Jul. 11, 2019 in related European Patent Application No. 18215675.2.
(Continued)

*Primary Examiner* — Darren W Gorman
*Assistant Examiner* — Juan C Barrera
(74) *Attorney, Agent, or Firm* — Wenderoth, Lind & Ponack, L.L.P.

(57) ABSTRACT

A spraying apparatus includes a spraying apparatus main body, a liquid introduction portion, a gas introduction portion, a gas-liquid spout portion, a liquid inlet, a gas inlet, a tubular flow passage, a spout, a flow passage having a taper, a straightener, and a projection portion. The liquid inlet allows a liquid flow to enter a gas-liquid mixer which is a space inside the annular gas introduction portion. The gas inlet allows a gas flow to enter the gas-liquid mixer. The straightener has an opening having an uneven shape provided in the flow passage having the taper. The projection portion is provided in the liquid introduction portion, protrudes to the gas-liquid mixer, and forms the straightener and a straightening outlet.

10 Claims, 12 Drawing Sheets

(51) Int. Cl.
*B01F 3/04* (2006.01)
*B05B 1/00* (2006.01)
*B05B 1/34* (2006.01)

(52) U.S. Cl.
CPC ..... *B05B 1/002* (2018.08); *B05B 1/3402* (2018.08); *B05B 7/0458* (2013.01)

(58) Field of Classification Search
USPC ..... 239/418
See application file for complete search history.

(56) References Cited

U.S. PATENT DOCUMENTS

| | | | |
|---|---|---|---|
| 5,295,628 | A | 3/1994 | Zuckschwerdt |
| 5,323,935 | A | 6/1994 | Gosselin et al. |
| 6,161,778 | A | 12/2000 | Haruch |
| 7,273,187 | B2 | 9/2007 | Kjeldal et al. |
| 2007/0158469 | A1* | 7/2007 | Burgener ..... B05B 7/0441 239/423 |
| 2014/0048622 | A1 | 2/2014 | Haruch |
| 2017/0203313 | A1 | 7/2017 | Tabata et al. |
| 2017/0266674 | A1 | 9/2017 | Isomi et al. |

FOREIGN PATENT DOCUMENTS

| | | |
|---|---|---|
| JP | 2017-170422 | 9/2017 |
| WO | 2008/024032 | 2/2008 |
| WO | 2014/028798 | 2/2014 |

OTHER PUBLICATIONS

English translation of a Search Report issued with an Office Action dated Aug. 24, 2020 in corresponding Chinese Patent Application No. 201910030456.5 with front page of the Office Action.

* cited by examiner

FIG. 3

| CONDITION No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| AREA OF RECTIFYING EXIT ($mm^2$) | 4.5 | 4.5 | 4.3 | 4.0 | 3.7 | 3.3 | 2.9 | 2.7 | 2.5 | 2.0 | 1.6 | 1.2 | 0.7 | 0.3 | 1.2 | 1.6 |
| AREA RATIO (%) | 100 | 98 | 94 | 88 | 81 | 73 | 64 | 60 | 55 | 45 | 35 | 26 | 16 | 6 | 26 | 35 |
| NOISE VALUE (dB) | 75.0 | 74.0 | 73.5 | 73.3 | 72.2 | 71.7 | 70.6 | 70.0 | 69.4 | 68.0 | 65.4 | 63.8 | 60.0 | 56.0 | 64.0 | 71.5 |
| AVERAGE PARTICLE DIAMETER (μm) | 9.5 | 9.6 | 9.5 | 9.5 | 9.6 | 9.4 | 9.6 | 9.5 | 9.4 | 9.6 | 9.7 | 9.6 | 12.0 | 15.0 | 9.5 | 9.2 |
| SHAPE OF PROJECTION PORTION | CONE | | | | | | | | | | | TRUNCATED CONE | | | TRUNCATED CONE OF WHICH SIDE SURFACE IS RECESSED | CYLINDER |
| HEIGHT OF PROJECTION PORTION (mm) | 1.90 | 2.00 | 2.10 | 2.20 | 2.30 | 2.40 | 2.50 | 2.54 | 2.60 | 2.70 | 2.80 | 1.90 | 1.90 | 1.90 | 1.90 | 1.90 |
| DIAMETER OF UPPER SURFACE OF PROJECTION PORTION (mm) | — | | | | | | | | | | | 2.10 | 2.20 | 2.30 | 2.10 | 1.90 |
| DIAMETER OF BOTTOM SURFACE OF PROJECTION PORTION (mm) | 6.0 | | | | | | | | | | | | | | | 1.90 |

SPRAYING APPARATUS

BACKGROUND

1. Technical Field

The present disclosure relates to a spraying apparatus of a two-fluid nozzle type which atomizes a liquid using a gas.

2. Description of the Related Art

A nozzle for atomizing a liquid is widely used in a space/material cooling apparatus, a humidifying apparatus, a chemical solution dispensing apparatus, a combustion apparatus, a dust control apparatus, or the like. The atomizing nozzle can be broadly divided into a single-fluid nozzle for atomizing a liquid by spouting the liquid from a micro aperture and a two-fluid nozzle for atomizing a liquid by using a gas such as an air, nitrogen, or steam. In general, the two-fluid nozzle is superior to the single-fluid nozzle in atomization performance because the two-fluid nozzle atomizes a liquid using energy of a gas.

As an example of the two-fluid nozzle for atomizing the liquid, for example, there is a two-fluid nozzle described in Japanese Patent Unexamined Publication No. 2017-170422. As illustrated in FIG. 4, the two-fluid nozzle described in Japanese Patent Unexamined Publication No. 2017-170422 includes spraying apparatus main body 310*a*, inner lid 313, and outer lid 314. Gas-liquid mixer 315 is constituted of inner lid 313, annular portion 324, straightening plate 330, and outer lid 314. Spraying apparatus 310 further includes spraying apparatus lid fixer 317.

In spraying apparatus 310, gas-liquid mixer 315 is disposed between inner lid 313, straightening plate 330, and annular portion 324. A liquid flow is introduced from a vicinity of an outer peripheral wall surface on an inner end surface 313*a* side of inner lid 313 which is a flat surface of gas-liquid mixer 315 on an upstream side. A gas flow is introduced from a surface opposite thereto to collide with the liquid flow. A gas-liquid mixed fluid flow advances to spout portion 316 while circulating around an inner surface of annular portion 324 of straightening plate 330 of gas-liquid mixer 315 facing gas-liquid mixer 315, and thereby atomization of the liquid in gas-liquid mixer 315 is promoted. Therefore, it is possible to provide a spraying apparatus capable of spraying a liquid having a small particle diameter, which is quickly vaporized and has little wetting or the like.

SUMMARY

A spraying apparatus includes a spraying apparatus main body, a liquid introduction portion, a gas introduction portion, a gas-liquid spout portion, a liquid inlet, a gas inlet, a tubular flow passage, a spout, a flow passage having a taper, a straightener, and a projection portion.

The spraying apparatus main body has a liquid flow passage and a gas flow passage.

The liquid introduction portion is provided at an end portion of the liquid flow passage.

The gas introduction portion having an annular shape is provided at an end portion of the gas flow passage.

The gas-liquid spout portion covers the liquid introduction portion and the gas introduction portion.

The liquid inlet is provided for communicating with the liquid flow passage at at least one place of the liquid introduction portion and allows a liquid flow to enter a gas-liquid mixer which is a space inside the annular gas introduction portion.

The gas inlet is provided for communicating with the gas flow passage at at least one place of the annular gas introduction portion and allows a gas flow to enter the gas-liquid mixer.

The tubular flow passage penetrates the gas-liquid spout portion, and mixes the gas flow exited from the gas inlet and the liquid flow exited from the liquid inlet, and allows a gas-liquid mixed fluid in which a liquid is atomized to exit.

The spout is provided in the gas-liquid spout portion for communicating with the tubular flow passage and spouts the gas-liquid mixed fluid.

The flow passage having a taper is provided in the gas-liquid spout portion and communicates with the spout.

The straightener has an opening having an uneven shape provided in the flow passage having a taper.

The projection portion is provided in the liquid introduction portion, protrudes to the gas-liquid mixer, and forms the straightener and a straightening outlet.

BRIEF DESCRIPTION OF THE DRAWINGS

FIG. 3 is a view illustrating a table of a relationship between an area of each portion of a straightener, a noise value, an average particle diameter in an embodiment.

DETAILED DESCRIPTIONS in the configuration of the two-fluid nozzle of the related art described in Japanese Patent Unexamined Publication No. 2017-170422, it is possible to make an average particle diameter of the sprayed liquid be 10 μm or less. However, in a case where a noise value of spray exceeds 70 dB and the spray is used for humidification or the like, it is difficult to apply to an indoor space where people live.

Hereinafter, exemplary embodiments of the disclosure will be described with reference to the drawings.

The exemplary embodiments relate to a spraying apparatus that atomizes and sprays a liquid by using a gas. An example of the gas includes air, nitrogen, oxygen, inert gas, or the like, which can be appropriately selected according to a purpose of use. An example of the liquid includes, water, ozone water, a chemical solution having a sterilizing and sterilizing function, a paint, a fuel oil or the like, which can be appropriately selected according to the purpose of use.

Figure 1A:
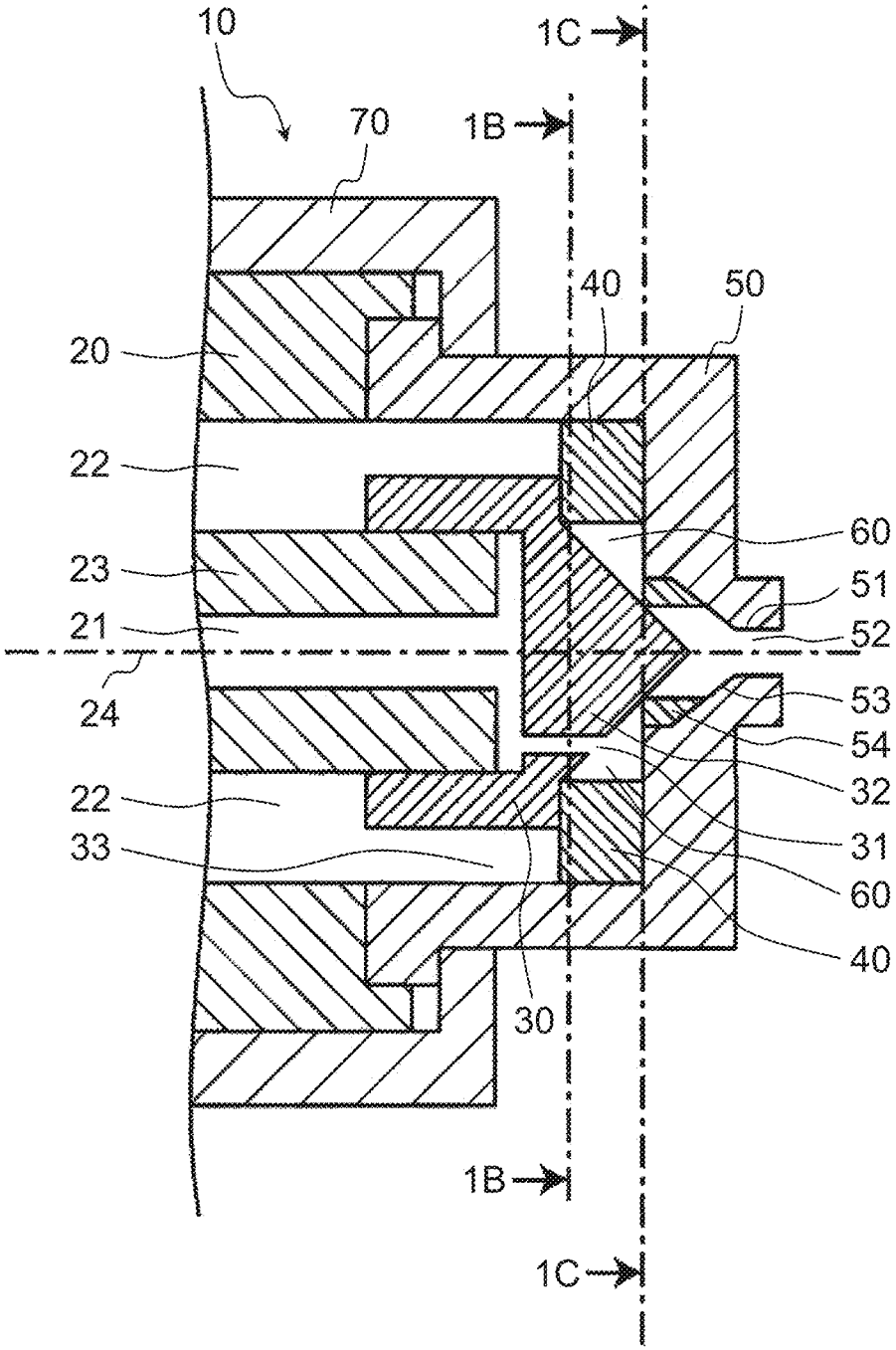
FIG. 1A is a sectional view of a spraying apparatus in an embodiment.

FIG. 1A is a sectional view of spraying apparatus 10 in an exemplary embodiment of the disclosure. Hereinafter, a configuration of spraying apparatus 10 will be described with reference to FIG. 1A.

Spraying apparatus 10 includes at least spraying apparatus main body 20, liquid introduction portion 30, gas introduction portion 40, and gas-liquid spout portion 50. Liquid introduction portion 30, gas introduction portion 40, and gas-liquid spout portion 50 constitute gas-liquid mixer 60. Spraying apparatus 10 may further include gas-liquid spout fixer 70.

Liquid flow passage 21 disposed along a direction of central axis 24 of a columnar member is formed in spraying apparatus main body 20. Furthermore, cylindrical gas flow passages 22 disposed along the axial direction at intervals are formed around liquid flow passage 21. Liquid flow passage 21 and gas flow passage 22 are sectioned by cylindrical portion 23 positioned at a center portion as a part of spraying apparatus main body 20. Only a tip portion of liquid flow passage 21 is illustrated and a liquid supply port (not illustrated) of a rear end portion is connected to a pump connected to a liquid tank, for example, via a liquid supply pipe. Only a tip side of gas flow passage 22 is illustrated and a gas supply port (not illustrated) at the rear end is connected to an air pressure source configured of an air compressor or the like, for example, via a gas supply pipe. The tip of cylindrical portion 23 slightly protrudes to a tip side from spraying apparatus main body 20 except cylindrical portion 23 and liquid introduction portion 30 is fixed to the tip thereof.

Liquid introduction portion 30 is disposed at the tip of spraying apparatus main body 20 and covers an opening of liquid flow passage 21. A groove-shaped liquid flow passage is formed on a surface of liquid introduction portion 30 facing an end surface of cylindrical portion 23. Liquid inlet 31 penetrating in the direction of central axis 24 is formed at at least one place deviated from central axis 24 of liquid introduction portion 30 in the radial direction. That is, liquid inlet 31 is provided so as to penetrate at least one place deviated from central axis 24 of liquid introduction portion 30 in the radial direction. Liquid inlet 31 is positioned, for example, in a vicinity of an inner peripheral surface of annular gas introduction portion 40 on an upstream side of gas-liquid mixer 60, causes liquid flow passage 21 and gas-liquid mixer 60 to communicate with each other, and causes a liquid flow flowing through liquid flow passage 21 to enter gas-liquid mixer 60. For example, conical projection portion 32 having a tapered shape protruding to gas-liquid mixer 60 is provided on a tip surface of liquid introduction portion 30. Conical projection portion 32 protrudes along central axis 24 so that the central axis of conical projection portion 32 coincides with central axis 24.

Gas-liquid spout portion 50 is disposed at the tip of spraying apparatus main body 20, covers liquid introduction portion 30 and gas introduction portion 40, covers the opening of gas flow passage 22, and has a cross section substantially in a shape of Ω in the axial direction. Gas-liquid spout portion 50 has gaps 33 having a cylindrical outer shape with liquid introduction portion 30 at predetermined intervals. Tubular flow passage 51 that causes the gas-liquid mixed fluid to exit and spout 52 that communicates with tubular flow passage 51 to spout the gas-liquid mixed fluid are formed at a tip portion of gas-liquid spout portion 50. Conical flow passage 53 having a taper communicating with tubular flow passage 51 is formed on an inner surface of gas-liquid spout portion 50. Straightener 54 having opening 80 having an uneven shape is provided in flow passage 53 having the taper.

Figure 1B:
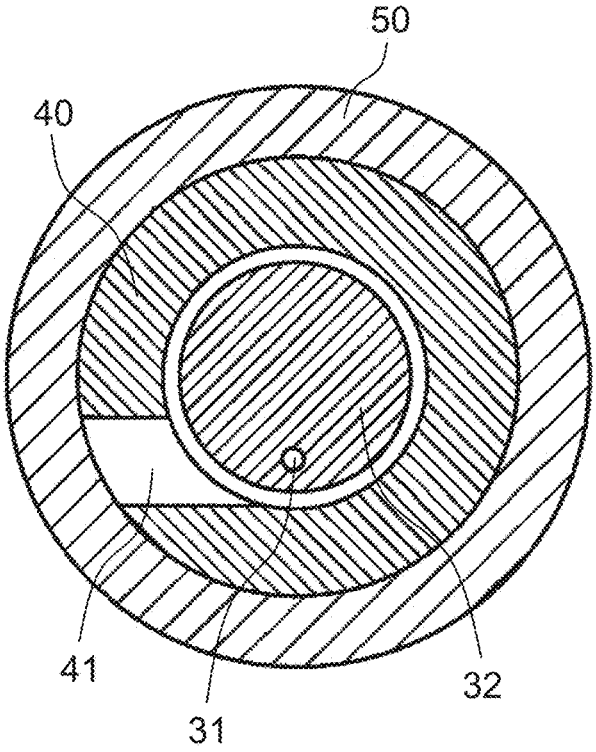
FIG. 1B is a sectional view which is taken along line 1B-1B of FIG. 1A.
Figure 1C:
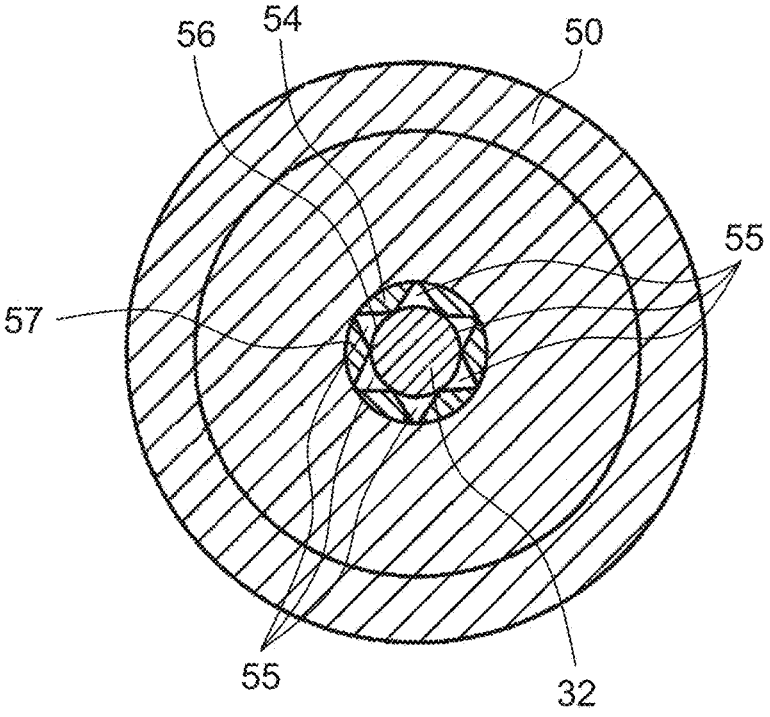
FIG. 1C is a sectional view which is taken along line 1C-1C of FIG. 1A.

As illustrated in FIG. 1C, the tip of conical projection portion 32 provided at liquid introduction portion 30 forms straightening outlet 55 with uneven-shaped opening 80 of straightener 54. A tip of the tip portion of conical projection portion 32 forms straightening outlet 55 in a state of entering uneven-shaped opening 80 of straightener 54.

Gas-liquid spout fixer 70 fixes gas-liquid spout portion 50 to the end surface of spraying apparatus main body 20. Gas-liquid spout portion 50 may be directly fixed to the end surface of spraying apparatus main body 20 without gas-liquid spout fixer 70.

FIG. 1B is a sectional view of spraying apparatus 10 which is taken along line 1B-1B of FIG. 1A. As illustrated in FIG. 1B, gas inlet 41 is formed by providing a notch or a gap at at least one place of gas introduction portion 40 along a tangential direction of the inner periphery of annular gas introduction portion 40. Gas inlet 41 communicates with gas flow passage 22 and causes the gas flow to enter the inside of the gas introduction portion.

Gas inlet 41 is disposed in the vicinity of liquid inlet 31. Furthermore, gas inlet 41 is disposed so that an entering direction of the gas flow entering from gas inlet 41 intersects with an entering direction of the liquid flow entering from liquid inlet 31. The gas flow entering from gas inlet 41 collides with the liquid flow entering from liquid inlet 31 and circulates along an inner peripheral surface around annular gas introduction portion 40 to atomize the liquid.

Figure 1D:
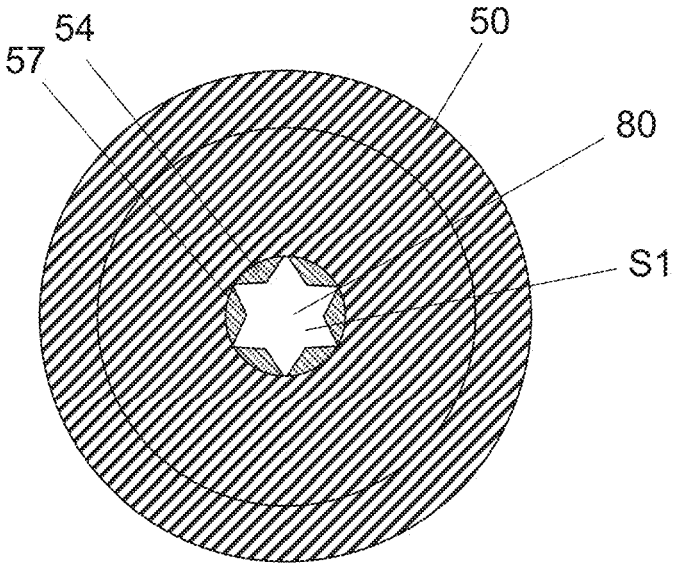
FIG. 1D is a view illustrating an opening having an uneven shape in FIG. 1C.
Figure 1E:
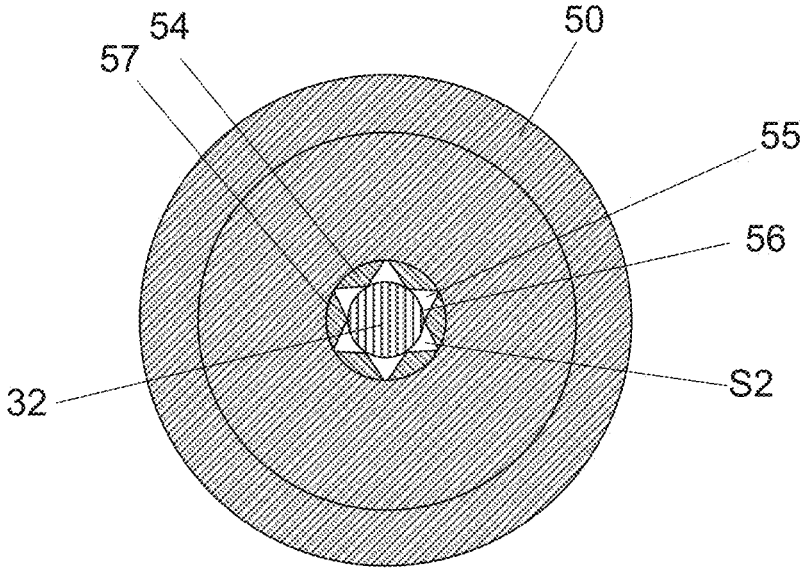
FIG. 1E is a view illustrating a straightening outlet in FIG. 1C.

FIG. 1C is a sectional view of spraying apparatus 10 which is taken along line 1C-1C of FIG. 1A. That is, FIG. 1C is a view illustrating a cross section in a case where spraying apparatus 10 of FIG. 1A is cut along an inner surface of gas-liquid spout portion 50 in a direction intersecting central axis 24 of spraying apparatus main body 20 and is viewed from a spraying apparatus main body 20 side. As illustrated in FIG. 1C, straightener 54 has opening 80 having the uneven shape and forms straightening outlet 55 between the uneven-shaped opening 80 and conical projection portion 32. Uneven-shaped opening 80 of straightener 54 is formed such that teeth such as triangles are formed on an inner peripheral surface of a cylinder or a conical cylinder so as to engrave an internal gear at predetermined intervals or evenly around the axis of the cylinder or the conical cylinder. The teeth of the triangles or the like protrude at predetermined intervals or evenly and straightening outlet 55 is formed between adjacent teeth. FIG. 1D is a view illustrating opening 80 having the uneven shape in FIG. 1C. FIG. 1E is a view illustrating straightening outlet 55 in FIG. 1C. In FIG. 1D, a hollow portion is opening 80 having the uneven shape. In FIG. 1E, six hollow portions are straightening outlet 55.

Here, the tip portion of conical projection portion 32 enters uneven-shaped opening 80 of straightener 54 and straightening outlet 55 is formed in an annular shape having the uneven shape on the outer periphery. A plurality of uneven shapes of straightener 54 are formed in the same shape or similar shape disposed at predetermined intervals or evenly around the axis of projection portion 32, and are disposed symmetrically around the axis, for example, in rotation symmetry. That is, straightening outlet 55 is constituted of the plurality of triangles disposed on a circumference of projection portion 32 in a case where spraying apparatus 10 is cut along the inner surface of gas-liquid spout portion 50 in the direction intersecting central axis 24 of spraying apparatus main body 20 and is viewed from a spraying apparatus main body 20 side.

Figure 1F:
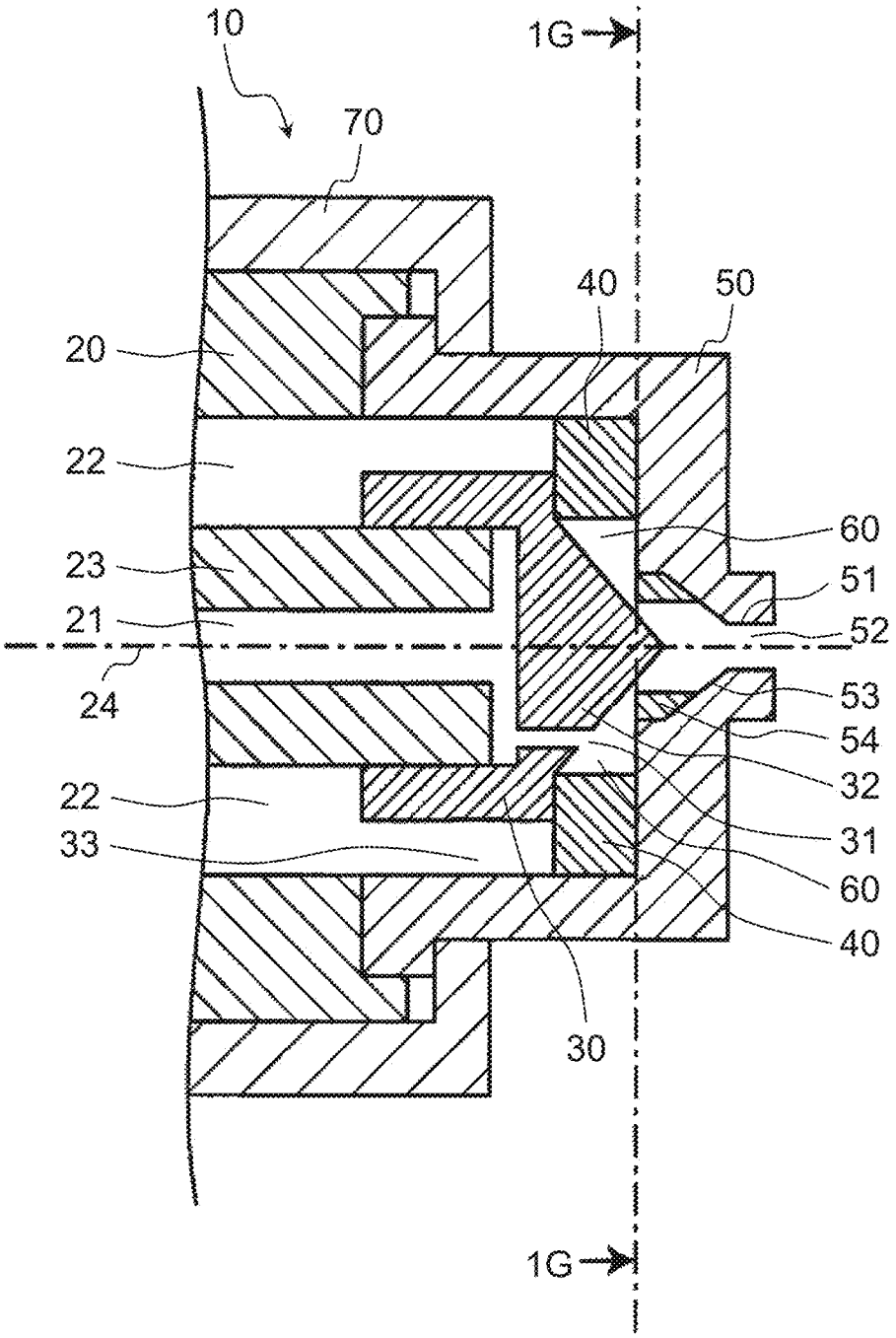
FIG. 1F is a sectional view of a spraying apparatus in a modification example of the embodiment.
Figure 1G:
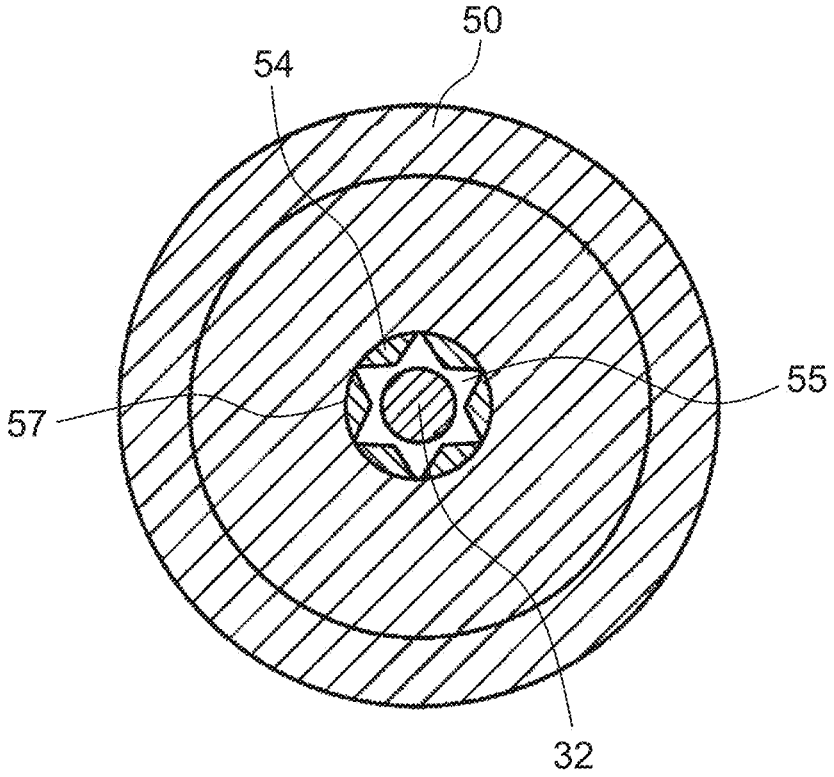
FIG. 1G is a sectional view which is taken along line 1G-1G of FIG. 1F.

For example, as illustrated in FIGS. 1A and 1C, an inner edge of uneven-shaped opening 80 of straightener 54 is in contact with the tip portion of conical projection portion 32, so that straightening outlet 55 of the plurality of triangles partitioned from each other can be formed. In addition, as another example of straightening outlet 55, it can be illustrated in condition numbers 9 and 10 of FIG. 3 and FIGS. 1F and 1G described later. FIG. 1G illustrates a sectional view of spraying apparatus 10 which is taken along line 1G-1G of FIG. 1F. That is, FIG. 1G is a view illustrating a cross section in a case where spraying apparatus 10 of FIG. 1F is cut along the inner surface of gas-liquid spout portion 50 in the direction intersecting central axis 24 of spraying apparatus main body 20 and is viewed from the spraying apparatus main body 20 side. A gap is formed without contact between the inner edge of uneven-shaped opening 80 of straightener 54 and the tip portion of conical projection portion 32, and can be formed as one annular straightening outlet 55 having the uneven shape of the plurality of triangles on the outer periphery. That is, straightening outlet 55 is constituted of a circular ring on the circumference of projection portion 32 and the plurality of triangles disposed around the circular ring in a case where spraying apparatus 10 is cut along the inner surface of gas-liquid spout portion 50 in the direction intersecting central axis 24 of spraying apparatus main body 20 and is viewed from spraying apparatus main body 20 side.

In such a configuration, the liquid supplied to spraying apparatus 10 becomes the liquid flow flowing through liquid flow passage 21 from the liquid supply port (not illustrated) on the apparatus tip side with respect to spraying apparatus main body 20. The liquid flow is supplied to gas-liquid mixer 60 through liquid flow passage 21 and liquid inlet 31. The gas supplied to spraying apparatus 10 becomes the gas flow flowing through gas flow passage 22 from the gas supply port (not illustrated) on the apparatus tip side with respect to spraying apparatus main body 20. The gas flow is supplied to gas-liquid mixer 60 through gap 33 and gas inlet 41.

When the gas flow and the liquid flow are supplied to gas-liquid mixer 60, the gas flow and the liquid flow are mixed with each other in gas-liquid mixer 60, and the liquid is atomized. Thereafter, the mixed and atomized liquid is straightened through straightening outlet 55 formed by uneven-shaped opening 80 of straightener 54 and conical projection portion 32, and spouts to an outside from spout 52 through tubular flow passage 51 provided in gas-liquid spout portion 50.

Hereinafter, an atomizing mechanism in gas-liquid mixer 60 will be described. The liquid flow that has flowed through liquid flow passage 21 passes through liquid inlet 31 provided in liquid introduction portion 30 and is supplied from the vicinity of the inner surface of annular gas introduction portion 40 of gas-liquid mixer 60 to the direction of gas-liquid spout portion 50.

On the other hand, the gas flow supplied to gas-liquid mixer 60 through gas inlet 41 with respect to the liquid flow supplied from liquid inlet 31 to gas-liquid mixer 60 collides the liquid flow and circulates along the inner peripheral surface of annular gas introduction portion 40. The liquid is pushed and spread on the inner peripheral surface of annular gas introduction portion 40 and becomes a thin film by colliding this way. Furthermore, from this state, the liquid flows in the circumferential direction along the inner peripheral surface of annular gas introduction portion 40, so that the liquid changes from the thin film to finer liquid droplets. Furthermore, a gas-liquid mixed fluid including the liquid droplets is aggregated in gas-liquid mixer 60. Therefore, the liquid droplets can further be atomized and a liquid having a smaller particle diameter can be sprayed from spout 52.

Noise generated when the gas-liquid mixed fluid spouts is generated by forming a turbulent flow between a spouting flow of the gas-liquid mixed fluid and the outside air by friction between the spouting flow of the gas-liquid mixed fluid of a high speed spouted from spout 52 of spraying apparatus 10 and the outside air. A region having a uniform spouting flow speed is generated in the vicinity of spout 52 from which the gas-liquid mixed fluid obtained by atomizing the liquid spouts, which causes a large turbulent flow between the gas-liquid mixed fluid and the outside air. Therefore, straightening outlet 55 formed by uneven-shaped opening 80 of straightener 54 and conical projection portion 32 is provided, so that the region having the uniform spouting flow in the vicinity of spout 52 is reduced and the turbulent flow formed between the gas-liquid mixed flow and the outside air can be decreased. Therefore, noise can be reduced.

Figure 1H:
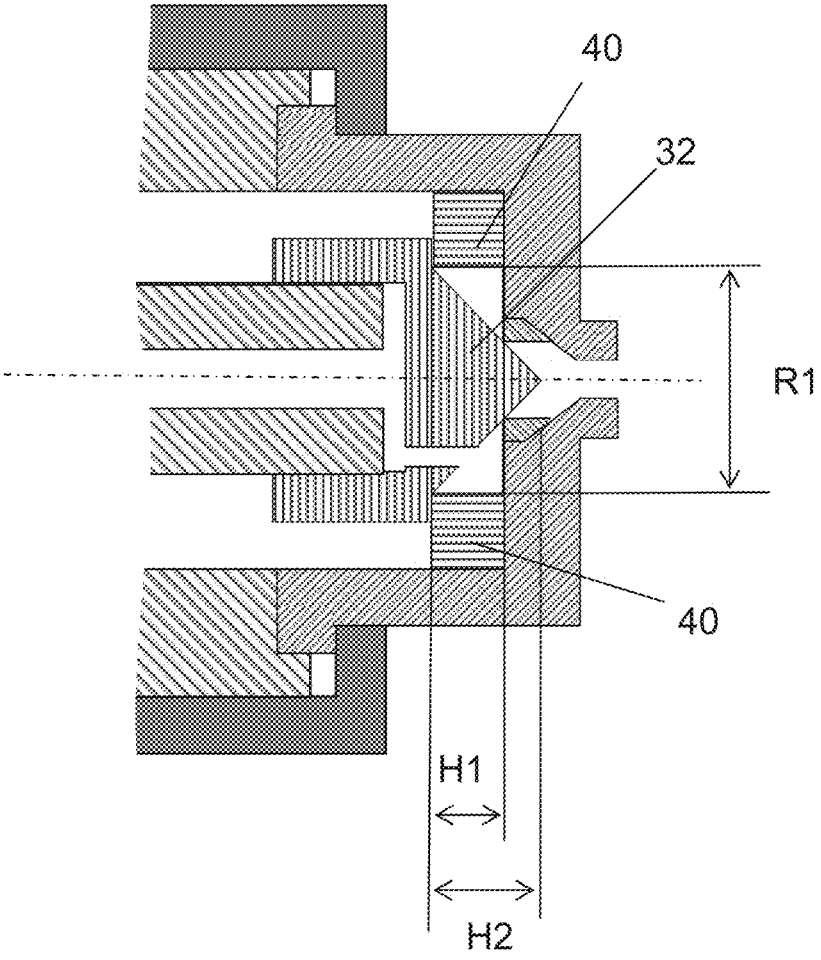
FIG. 1H is a view illustrating a dimension of a gas introduction portion in FIG. 1A.
Figure 1I:
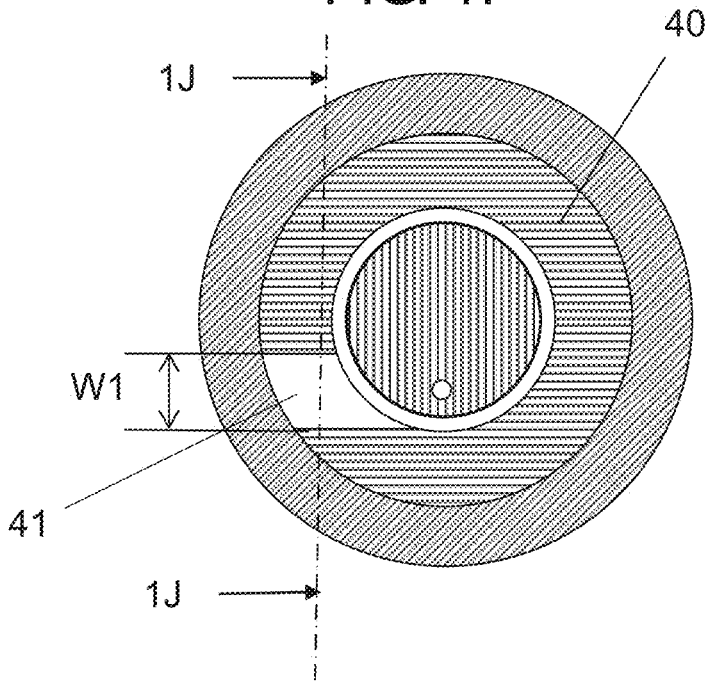
FIG. 1I is a view illustrating a dimension of a gas inlet in FIG. 1A.
Figure 1J:
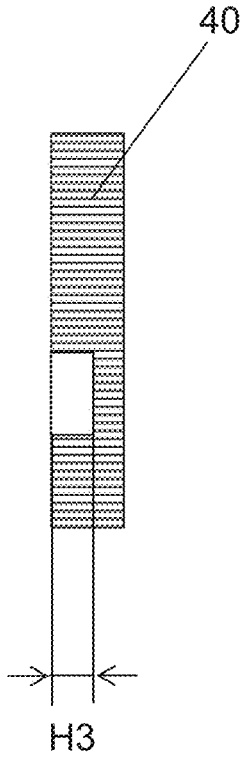
FIG. 1J is a sectional view which is taken along line 1J-1J of FIG. 1I.

FIG. 1H is a view illustrating a dimension of gas introduction portion 40 in FIG. 1A. FIG. 1I is a view illustrating a dimension of gas inlet 41 in FIG. 1A. FIG. 1J is a sectional view which is taken along line 1J-1J of FIG. 1I. Annular gas introduction portion 40 forming gas-liquid mixer 60 has inner diameter R1 of 6.0 mm and height H1 of 1.9 min (see FIG. 1H). Inscribed circle 56 of uneven-shaped opening 80 (see FIG. 1D) of straightener 54 has a diameter of 1.9 mm and circumscribed circle 57 of the opening has a diameter of 2.8 mm (see FIG. 1E). Area S1 (see FIG. 1D) of the opening is 4.52 $mm^2$. In FIG. 1D, an area of the hollow portion is area S1 of uneven-shaped opening 80. Tubular flow passage 51 (see FIG. 1A) of gas-liquid spout portion 50 has a diameter of 1.0 mm and a flow passage cross-sectional area of 0.79 $mm^2$. Liquid inlet 31 (see FIG. 1A) has a diameter of 0.6 mm. A flow passage cross-section of gas inlet 41 in a direction orthogonal to the axis is rectangular, width W1 (see FIG. 1I) is 2.0 mm, and height H3 (see FIG. 1J) is 1.0 mm. A diameter of the bottom surface of conical projection portion 32 is 6 mm and height H2 (see FIG. 1H) of projection portion 32 is 2.8 mm. Opening area S2 (see FIG. 1E) of straightening outlet 55 is 1.6 $mm^2$. In FIG. 1E, a total area of the six hollow portions is the area of straightening outlet 55.

Spraying apparatus 10 was supplied with a compressed air, which is an example of the gas, pressurized by 0.2 MPa (gauge pressure) and water, which is an example of the liquid, pressurized by 0.23 MPa (gauge pressure). A Sauter average particle diameter of the water atomized under the above conditions was evaluated by a laser diffraction technique. A measurement according to the laser diffraction technique was carried out at a position of 300 mm away from the tip of spraying apparatus 10 and the Sauter average diameter was 9.7 μm. A noise value under the above conditions was measured with a noise level meter at a position of 1000 mm from the tip of spraying apparatus 10 and it was 65.4 dB.

The shape of projection portion 32 may be any shape as long as it has a tapered shape from the bottom surface of projection portion 32 on the upstream side to the tip portion on the downstream side, and examples of the tapered shape are illustrated in FIGS. 2A to 2F. Here, the upstream side is a side on which spraying apparatus main body 20 is formed and the downstream side is a side on which spout 52 is formed. In other words, projection portion 32 has a portion where the cross-sectional area decreases toward spout 52.

Figure 2A:
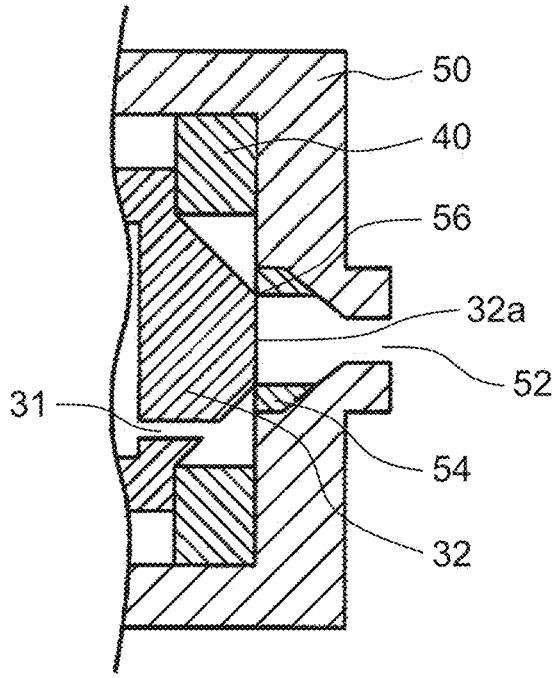
FIG. 2A is a sectional view of a spraying apparatus illustrating an example of a projection portion in an embodiment.

In projection portion 32 of FIG. 2A, upper surface 32*a* of the tip portion of conical projection portion 32 is on the same plane as the opening surface of uneven-shaped opening 80 of straightener 54 and a diameter of upper surface 32*a* is equal to a diameter of inscribed circle 56 of uneven-shaped opening 80 of straightener 54.

Figure 2B:
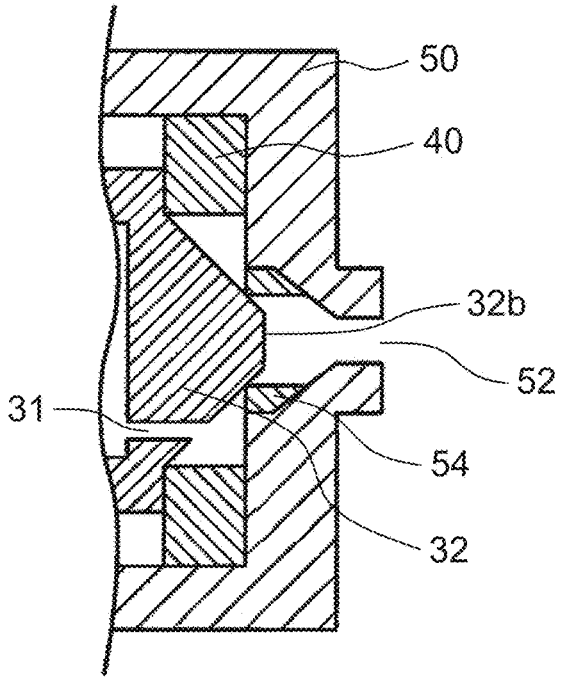
FIG. 2B is a sectional view of a spraying apparatus illustrating another example of a projection portion in an embodiment.

In projection portion 32 of FIG. 2B, tip portion 32*b* of conical projection portion 32 enters uneven-shaped opening 80 of straightener 54.

Figure 2C:
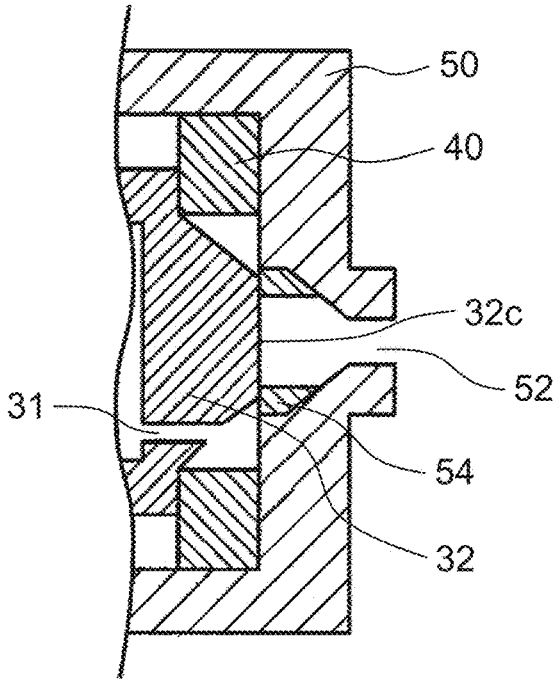
FIG. 2C is a sectional view of a spraying apparatus illustrating still another example of a projection portion in an embodiment.

In projection portion 32 of FIG. 2C, upper surface 32*c* of the tip portion of conical projection portion 32 is on the same plane as the surface of uneven-shaped opening 80 of straightener 54 and a diameter of upper surface 32*c* is greater than a diameter of inscribed circle 56 of uneven-shaped opening 80 of straightener 54, and is smaller than a diameter of circumscribed circle 57.

Figure 2D:
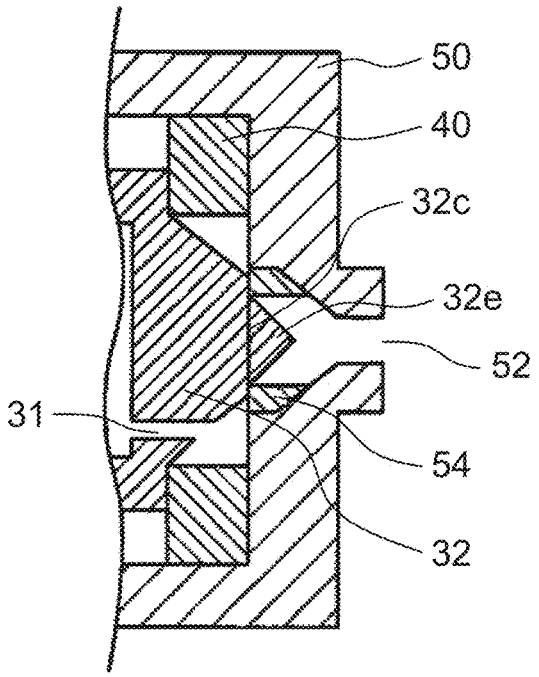
FIG. 2D is a sectional view of a spraying apparatus illustrating still another example of a projection portion in an embodiment.

In projection portion 32 of FIG. 2D, conical protrusion 32*e* having a bottom surface with a diameter smaller than the diameter of inscribed circle 56 is formed on upper surface 32*c* of the tip portion of conical projection portion 32 illustrated in FIG. 2C.

Figure 2E:
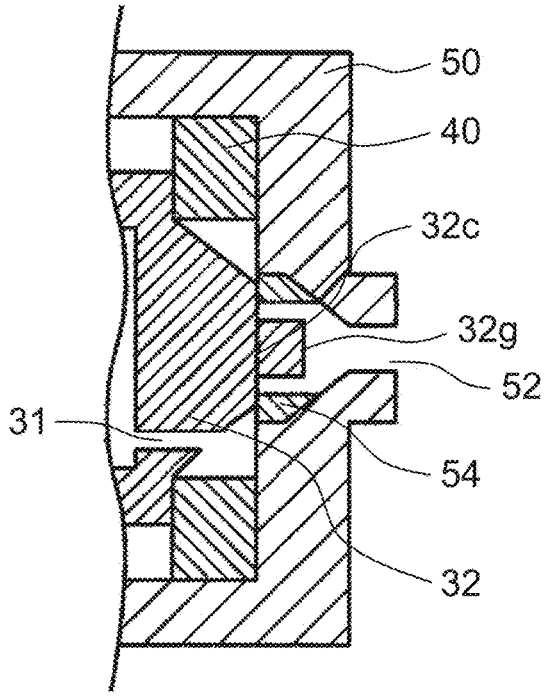
FIG. 2E is a sectional view of a spraying apparatus illustrating still another example of a projection portion in an embodiment.

In projection portion 32 of FIG. 2E, columnar protrusion 32*g* having a bottom surface with a diameter smaller than the diameter of the inscribed circle is formed on upper surface 32*c* of conical projection portion 32 illustrated in FIG. 2C.

Figure 2F:
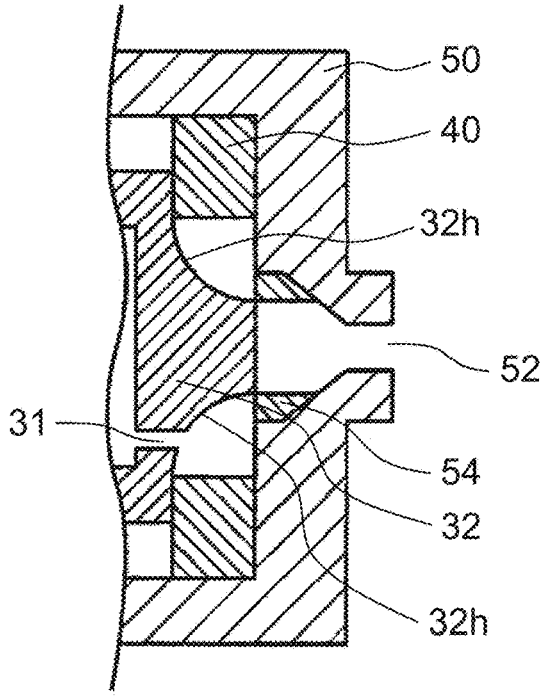
FIG. 2F is a sectional view of a spraying apparatus illustrating still another example of a projection portion in an embodiment.
Figure 4:
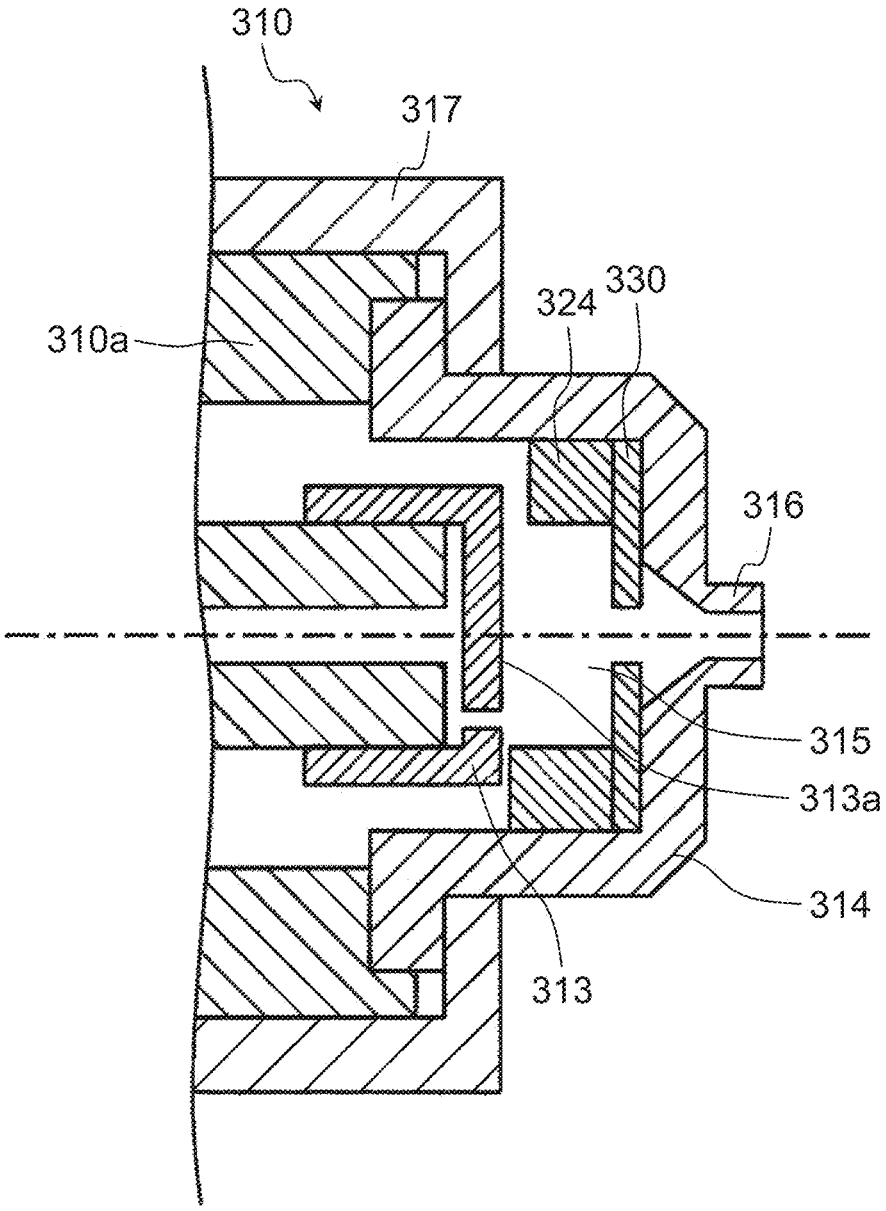
FIG. 4 is a sectional view illustrating a schematic configuration of a spraying apparatus of the related art.

In projection portion 32 of FIG. 2F, a cross-sectional shape of side surface 32*h* of conical projection portion 32 illustrated in FIG. 2A is curved and recessed, and an inclination of the side surface becomes steep gradually from the bottom surface on the upstream side to the tip portion.

A relationship between the area of uneven-shaped opening 80 of straightener 54, the area of straightening outlet 55, the area of tubular flow passage 51, the noise value, and the average particle diameter is illustrated in FIG. 3.

In spraying apparatus 10, in a case where uneven-shaped opening 80 of straightener 54 is 4.52 $mm^2$ and the area of tubular flow passage 51 is 0.79 $mm^2$, the shape of projection portion 32 was formed into a conical shape, a truncated cone shape, or a cylindrical shape, and the area of the straightening outlet was changed to measure the noise value and the average particle diameter. Uneven-shaped opening 80 of straightener 54 illustrated in FIG. 1C had a shape of an internal gear in which the diameter of inscribed circle 56 is 1.9 mm, the diameter of circumscribed circle 57 is 2.8 mm, and the number of teeth is 6.

In condition Nos. 1 to 11 of FIG. 3, the height of the cone of conical projection portion 32 is changed, so that the tip of conical projection portion 32 enters uneven-shaped opening 80 of straightener 54 and the area of straightening outlet 55 is changed. In condition Nos. 12 to 15, the upper surface of conical projection portion 32 is on the same plane as uneven-shaped opening 80 of straightener 54 and the diameter of the upper surface of conical projection portion 32 is changed and the area of straightening outlet 55 is changed.

An area ratio of straightening outlet 55 with respect to the area of uneven-shaped opening 80 of straightener 54 decreased, the noise value reduced, the area ratio was 60% or less, and the noise value was 70 dB or less.

On the other hand, in condition Nos. 13 and 14, the area of straightening outlet 55 was smaller than the area of tubular flow passage 51 of 0.79 $mm^2$ and the average particle diameter was 10 μm or more. This is because a flow rate of the gas-liquid mixed fluid controlled by tubular flow passage 51 is controlled by straightening outlet 55, the flow rate of the gas-liquid mixed fluid decreases, and in accordance therewith, a flow rate of the gas flow entering from gas inlet 41 also decreases, it is difficult to atomize the liquid in gas-liquid mixer 60.

In addition, in a case of the truncated cone in which the cross-sectional shape of the side surface illustrated in FIG. 2F was curved and recessed, condition No. 15 had the noise value and the average particle diameter which are substantially the same as those in the case of the truncated cone of condition No. 12.

Therefore, it is preferable that the area ratio of straightening outlet 55 with respect to the area of uneven-shaped opening 80 of straightener 54 is greater than 0% and 60% or less, and the area of straightening outlet 55 is greater than the area of tubular flow passage 51.

In condition No. 16, a case where the upper surface of cylindrical projection portion 32 is on the same plane as uneven-shaped opening 80 of straightener 54 is illustrated. In this case, the effect of reducing the noise was excellent in which the average particle diameter was 10 μm or less, but the noise value was a value exceeding 70 dB, and the shape of projection portion 32 was the conical shape or the truncated cone shape. This is because the shape of projection portion 32 is the tapered shape such as the conical shape or the truncated cone shape, the flow to straightening outlet 55 is guided while the flow of the gas-liquid mixed fluid which is mixed by gas-liquid mixer 60 is restricted by the side surface of projection portion 32, so that a turbulent flow formed between the spouting flow of the gas-liquid mixed fluid and the outside air can be further reduced.

Therefore, it is preferable that the shape of projection portion 32 is formed in the tapered shape such that straightening outlet 55 is formed between the bottom surface of projection portion 32 on the upstream side and straightener 54 having uneven-shaped opening 80, and the diameter of projection portion 32 is reduced toward the tip portion of projection portion 32 positioned on the downstream side.

According to spraying apparatus 10 of the embodiment, annular gas introduction portion 40, projection portion 32, and straightener 54 are provided between liquid introduction portion 30 and gas-liquid spout portion 50, and gas-liquid mixer 60 and straightening outlet 55 are reliably formed between gas-liquid spout portion 50 and liquid introduction portion 30. Therefore, in gas-liquid mixer 60, the liquid flow entering from liquid inlet 31 and the gas flow entering from gas inlet 41 collide each other, spread on the inner peripheral surface of annular gas introduction portion 40, and then circulate and agitate along the inner peripheral surface, the liquid is atomized, and the atomized liquid is sprayed from gas-liquid spout portion 50 while being straightened by straightening outlet 55. As a result, it is possible to provide spraying apparatus 10 capable of spraying the liquid with a small particle diameter, which is quickly vaporized and is small in wetting or the like, with low noise. More specifically, it is possible to provide spraying apparatus 10 of a two-fluid nozzle type in which the liquid having a particle diameter greater than 0 μm and 10 μm or less with the noise value greater than 0 dB and 70 dB or less can be sprayed as an example of the small particle diameter in which the liquid is quickly vaporized and is small in wetting or the like.

In the embodiment, gas inlet 41 is disposed in the vicinity of liquid inlet 31 and is disposed, so that the entering direction of the gas flow entering from gas inlet 41 intersects with respect to the entering direction of the liquid flow entering from liquid inlet 31. However, it is not limited to such a disposition. For example, gas inlet 41 may be disposed at a position substantially facing liquid inlet 31 with respect to central axis 24 of spraying apparatus main body 20 and a plurality of gas inlets 41 and liquid inlets 31 may be disposed.

It is possible to achieve the respective effects included in exemplary embodiments by suitably combining any exemplary embodiment or modification example of the above-described various exemplary embodiments or modification examples. Combinations of the exemplary embodiments, combinations of the examples, or combinations of the exemplary embodiments and the examples are possible and combinations of features in different exemplary embodiments or examples are also possible.

As described above, according to the spraying apparatus of the disclosure, the gas-liquid mixer and the straightening outlet are formed between the gas-liquid spout portion and the liquid introduction portion. The liquid flow entering from the liquid inlet and the gas flow entering from the gas inlet collide each other, spread on the inner peripheral surface of the annular gas introduction portion, and then circulate and agitate along the inner peripheral surface, and the liquid is atomized. The atomized liquid spouts from the gas-liquid spout portion while being straightened by the straightening outlet. Therefore, it is possible to provide the spraying apparatus capable of spraying the liquid with a small particle diameter, which is quickly vaporized and is small in wetting or the like, with low noise.

As a more specific example, it is possible to provide the spraying apparatus of the two-fluid nozzle type in which the liquid having a particle diameter of 10 μm or less as an example of the small particle diameter can be sprayed, and the noise value is, for example, 70 dB or less in which the liquid is quickly vaporized and is small in wetting or the like.

The spraying apparatus of the disclosure can spray the liquid of which the particle diameter is small such as substantially 10 μm or less as an example of the small particle diameter in which the liquid is quickly vaporized and is small in wetting or the like, and the noise value is, for example, 70 dB or less. The spraying apparatus can be widely used for space/material cooling, humidifying, chemical solution dispensing, combustion, dust control, or the like.

What is claimed is:

1. A spraying apparatus comprising:

a spraying apparatus main body that has a liquid flow passage and a gas flow passage;

a liquid introduction portion that is provided at an end portion of the liquid flow passage;

an annular gas introduction portion that is provided at an end portion of the gas flow passage;

a gas-liquid spout portion that covers the liquid introduction portion and the annular gas introduction portion;

a liquid inlet that is provided for communicating with the liquid flow passage at at least one place of the liquid introduction portion and allows a liquid flow to enter a gas-liquid mixer, which is a space inside the annular gas introduction portion;

a gas inlet that is provided for communicating with the gas flow passage at at least one place of the annular gas introduction portion and allows a gas flow to enter the gas-liquid mixer;

a tubular flow passage, which penetrates the gas-liquid spout portion, that mixes the gas flow exited from the gas inlet and the liquid flow exited from the liquid inlet, and allows a gas-liquid mixed fluid in which a liquid is atomized to exit;

a spout that is provided in the gas-liquid spout portion for communicating with the tubular flow passage and spouts the gas-liquid mixed fluid;

a flow passage that is provided in the gas-liquid spout portion and has a taper communicating with the spout;

a straightener provided in the flow passage, the straightener having an opening for noise reduction; and a projection portion that is provided in the liquid introduction portion, protrudes to the gas-liquid mixer, and forms the straightener and a straightening outlet, wherein the straightener is provided in the gas-liquid spout portion on a spout side of the gas-liquid mixer to form the straightening outlet, wherein, along a plane that is orthogonal to a central axis of the spraying apparatus main body that intersects the opening of the straightener, a width of the opening along a line extending from a center of the projection portion radially outward varies around a circumference of the projection portion, and wherein in a case where the spraying apparatus is cut along an inner surface of the gas-liquid spout portion in a direction intersecting the central axis of the spraying apparatus main body and is viewed from a spraying apparatus main body side, an area ratio of an area of the straightening outlet to an area of the opening of the straightener is greater than 0% and 60% or less, and the area of the straightening outlet is greater than an area of the tubular flow passage.

2. The spraying apparatus of claim 1, wherein in a case where a side on which the spraying apparatus main body is formed is defined as an upstream side and a side on which the spout is formed is defined as a downstream side, the projection portion has a tapered shape from a bottom surface of the projection portion on the upstream side toward a tip portion of the projection portion on the downstream side.

3. The spraying apparatus of claim 1, wherein in the case where the spraying apparatus is cut along the inner surface of the gas-liquid spout portion in the direction intersecting the central axis of the spraying apparatus main body and is viewed from the spraying apparatus main body side, the straightening outlet includes a plurality of triangles disposed on the circumference of the projection portion.

4. The spraying apparatus of claim 1, wherein in the case where the spraying apparatus is cut along the inner surface of the gas-liquid spout portion in the direction intersecting the central axis of the spraying apparatus main body and is viewed from the spraying apparatus main body side, the straightening outlet includes a circular ring on the circumference of the projection portion and a plurality of triangles disposed around the circular ring.

5. The spraying apparatus of claim 1, wherein the width of the opening along the line extending from the center of the projection portion radially outward continuously varies around the circumference of the projection portion.

6. The spraying apparatus of claim 1, wherein the straightening outlet is a gap on an upstream side end of the straightener between an inner edge of the opening and the projection portion, and the straightener communicates with the tubular flow passage.

7. A spraying apparatus comprising:

a spraying apparatus main body that has a liquid flow passage and a gas flow passage;

a liquid introduction portion that is provided at an end portion of the liquid flow passage;

an annular gas introduction portion that is provided at an end portion of the gas flow passage;

a gas-liquid spout portion that covers the liquid introduction portion and the annular gas introduction portion;

a liquid inlet that is provided for communicating with the liquid flow passage at at least one place of the liquid introduction portion and allows a liquid flow to enter a gas-liquid mixer, which is a space inside the annular gas introduction portion;

a gas inlet that is provided for communicating with the gas flow passage at at least one place of the annular gas introduction portion and allows a gas flow to enter the gas-liquid mixer;

a tubular flow passage, which penetrates the gas-liquid spout portion, that mixes the gas flow exited from the gas inlet and the liquid flow exited from the liquid inlet, and allows a gas-liquid mixed fluid in which a liquid is atomized to exit;

a spout that is provided in the gas-liquid spout portion for communicating with the tubular flow passage and spouts the gas-liquid mixed fluid;

a flow passage that is provided in the gas-liquid spout portion and has a taper communicating with the spout;

a straightener provided in the flow passage, the straightener having an opening for noise reduction; and a projection portion that is provided in the liquid introduction portion, protrudes to the gas-liquid mixer, and forms the straightener and a straightening outlet, wherein the straightener is provided in the gas-liquid spout portion on a spout side of the gas-liquid mixer to form the straightening outlet, and wherein in a case where the spraying apparatus is cut along an inner surface of the gas-liquid spout portion in a direction intersecting a central axis of the spraying apparatus main body and is viewed from a spraying apparatus main body side, the straightening outlet includes a plurality of triangles disposed on a circumference of the projection portion, an area ratio of an area of the straightening outlet to an area of the opening of the straightener is greater than 0% and 60% or less, and the area of the straightening outlet is greater than an area of the tubular flow passage.

8. The spraying apparatus of claim 7, wherein the straightening outlet is a gap on an upstream side end of the straightener between an inner edge of the opening and the projection portion, and the straightener communicates with the tubular flow passage.

9. A spraying apparatus comprising:

a spraying apparatus main body that has a liquid flow passage and a gas flow passage;

a liquid introduction portion that is provided at an end portion of the liquid flow passage;

an annular gas introduction portion that is provided at an end portion of the gas flow passage;

a gas-liquid spout portion that covers the liquid introduction portion and the annular gas introduction portion;

a liquid inlet that is provided for communicating with the liquid flow passage at at least one place of the liquid introduction portion and allows a liquid flow to enter a gas-liquid mixer, which is a space inside the annular gas introduction portion;

a gas inlet that is provided for communicating with the gas flow passage at at least one place of the annular gas introduction portion and allows a gas flow to enter the gas-liquid mixer;

a tubular flow passage, which penetrates the gas-liquid spout portion, that mixes the gas flow exited from the gas inlet and the liquid flow exited from the liquid inlet, and allows a gas-liquid mixed fluid in which a liquid is atomized to exit;

a spout that is provided in the gas-liquid spout portion for communicating with the tubular flow passage and spouts the gas-liquid mixed fluid;

a flow passage that is provided in the gas-liquid spout portion and has a taper communicating with the spout;

a straightener provided in the flow passage, the straightener having an opening for noise reduction; and a projection portion that is provided in the liquid introduction portion, protrudes to the gas-liquid mixer, and forms the straightener and a straightening outlet, wherein the straightener is provided in the gas-liquid spout portion on a spout side of the gas-liquid mixer to form the straightening outlet, and wherein in a case where the spraying apparatus is cut along an inner surface of the gas-liquid spout portion in a direction intersecting a central axis of the spraying apparatus main body and is viewed from a spraying apparatus main body side, the straightening outlet includes a circular ring on a circumference of the projection portion, a plurality of triangles are disposed around the circular ring, an area ratio of an area of the straightening outlet to an area of the opening of the straightener is greater than 0% and 60% or less, and the area of the straightening outlet is greater than an area of the tubular flow passage.

10. The spraying apparatus of claim 9, wherein the straightening outlet is a gap on an upstream side end of the straightener between an inner edge of the opening and the projection portion, and the straightener communicates with the tubular flow passage.

* * * * *